US009558691B2

(12) United States Patent
Jung et al.

(10) Patent No.: US 9,558,691 B2
(45) Date of Patent: Jan. 31, 2017

(54) DISPLAY METHOD AND APPARATUS HAVING A DISPLAY PANEL WITH A BACKLIGHT UNIT UTILIZING WHITE AND BLUE LIGHT SOURCES

(71) Applicant: SAMSUNG ELECTRONICS CO., LTD., Suwon-si (KR)

(72) Inventors: Jong-hoon Jung, Suwon-si (KR); Seong-phil Cho, Seoul (KR); Dae-sik Kim, Hwaseong-si (KR); Ho-seop Lee, Seongnam-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 242 days.

(21) Appl. No.: 13/922,550

(22) Filed: Jun. 20, 2013

(65) Prior Publication Data

US 2013/0342589 A1 Dec. 26, 2013

(30) Foreign Application Priority Data

Jun. 20, 2012 (KR) ..... 10-2012-0066417

(51) Int. Cl.
*G09G 3/36* (2006.01)
*G09G 3/32* (2016.01)
*G09G 3/34* (2006.01)

(52) U.S. Cl.
CPC ..... *G09G 3/32* (2013.01); *G09G 3/3413* (2013.01); *G09G 3/3426* (2013.01);
(Continued)

(58) Field of Classification Search
CPC ..... G09G 2310/0237; G09G 2310/024; G09G 3/06; G09G 3/16–3/19; G09G 3/22–3/28; G09G 3/34–3/3426
See application file for complete search history.

(56) References Cited

U.S. PATENT DOCUMENTS 7,248,268 B2 7/2007 Brown Elliott et al.
7,293,907 B2 11/2007 Kim et al.
(Continued)

FOREIGN PATENT DOCUMENTS

KR 10-2005-0070193 A 7/2005
KR 10-2006-0000544 A 1/2006
(Continued)

OTHER PUBLICATIONS

International Search Report (PCT/ISA/210) dated Oct. 22, 2013, issued by the International Searching Authority in International Application No. PCT/KR2013/005443.
(Continued)

*Primary Examiner* — Sanghyuk Park
(74) *Attorney, Agent, or Firm* — Sughrue Mion, PLLC

(57) ABSTRACT

A display apparatus is disclosed. The display apparatus includes a panel unit which comprises a plurality of sub pixels having different colors; a backlight unit which provides backlight to the panel unit using a white light source and a blue light source; an image processing unit which converts image data into first color frame data and second color frame data; a panel driving unit which turns on a first color sub pixel according to the first color frame data, and which turns on a second color sub pixel according to the second color frame data; a backlight driving unit for driving the backlight unit; and a control unit which controls the backlight driving unit to consecutively turn on the white light source and the blue light source according to operations of the panel driving unit. Accordingly, brightness may be enhanced.

26 Claims, 19 Drawing Sheets

(52) U.S. Cl.
CPC ..... *G09G 2300/0452* (2013.01); *G09G 2310/0235* (2013.01); *G09G 2340/06* (2013.01)

(56) References Cited

U.S. PATENT DOCUMENTS

| | | | | |
|---|---|---|---|---|
| 7,580,023 | B2 | 8/2009 | Pugh et al. | |
| 7,629,988 | B2 | 12/2009 | Chung et al. | |
| 7,656,476 | B2 | 2/2010 | So | |
| 7,782,283 | B2 | 8/2010 | Hong et al. | |
| 2003/0193629 | A1* | 10/2003 | Yamaguchi | 349/61 |
| 2005/0140636 | A1 | 6/2005 | Chung et al. | |
| 2005/0286264 | A1 | 12/2005 | Kim et al. | |
| 2006/0146067 | A1* | 7/2006 | Schweng et al. | 345/591 |
| 2007/0182682 | A1 | 8/2007 | Hong et al. | |
| 2007/0268429 | A1 | 11/2007 | So | |
| 2009/0167779 | A1* | 7/2009 | Inuzuka | 345/589 |
| 2010/0053044 | A1* | 3/2010 | Lee et al. | 345/80 |
| 2010/0099324 | A1 | 4/2010 | So | |
| 2011/0273906 | A1* | 11/2011 | Nichol et al. | 362/607 |
| 2011/0292086 | A1 | 12/2011 | Liao et al. | |
| 2012/0019567 | A1* | 1/2012 | Yamazaki | G09G 3/3677 345/690 |
| 2012/0274878 | A1 | 11/2012 | Kunz et al. | |
| 2013/0162934 | A1 | 6/2013 | Hirayama et al. | |

FOREIGN PATENT DOCUMENTS

| | | | |
|---|---|---|---|
| KR | 10-2007-0111610 | A | 11/2007 |
| KR | 10-2008-0002301 | A | 1/2008 |
| KR | 10-0815916 | B1 | 3/2008 |
| WO | 2011/085897 | A1 | 7/2011 |
| WO | 2012/029701 | A1 | 3/2012 |

OTHER PUBLICATIONS

Written Opinion (PCT/ISA/237) dated Oct. 22, 2013, issued by the International Search Authority in International Application No. PCT/KR2013/005443.

* cited by examiner

DISPLAY METHOD AND APPARATUS HAVING A DISPLAY PANEL WITH A BACKLIGHT UNIT UTILIZING WHITE AND BLUE LIGHT SOURCES

CROSS-REFERENCE TO RELATED APPLICATIONS

This application claims priority from Korean Patent Application No. 10-2012-0066417, filed in the Korean Intellectual Property Office on Jun. 20, 2012, the disclosure of which is incorporated herein by reference, in its entirety.

BACKGROUND

1. Field

Methods and apparatuses consistent with the exemplary embodiments relate to a display method and apparatus having a display panel with a backlight unit utilizing blue and white light sources.

2. Description of the Prior Art

As a result of the continuing development of electronic technologies, various types of display apparatuses are being developed and distributed. In particular, numerous large scale flat display apparatuses such as LCD (Liquid Crystal Display) display apparatuses and PDP display apparatuses have recently become widespread and used in general households.

An LCD display apparatus is unable to radiate light itself, and thus, generally uses a backlight unit. A backlight unit has various light sources such as a white LED, and provides backlight towards an LCD panel. The LCD panel uses an R, G, B color filter to filter the backlight and to display a color image.

R, G, B color filters exist independently. Therefore, a passing region for each light source is defined, thereby limiting a range for expressing a color.

In a case of a white LED which uses a general YAG fluorescent substance, only about 75% of color region of NTSC (National Television Systems Committee) can be expressed. A sub pixel structure where each of R, G, B are independently configured is unable to pass white light in its original state. Rather, the sub-pixel structure has to express the white light color by using a combination of RGB three colors. This reduces the brightness, which has been a problem.

In order to resolve this problem, the FSC method was developed which turns on R, G, B light sources consecutively and embodies a color, instead of using a color filter. However, the FSC method had a problem of causing a color break up (CBU) phenomenon. Besides, R, G, B light sources have different brightness and changing characteristics of wavelength due to temperatures, thereby creating the problem of changing the color senses when used for a long time.

SUMMARY

An aspect of the exemplary embodiments relates to a backlight unit which may embody a full color region and high brightness, a display panel and display apparatus, and a display method thereof.

According to an exemplary embodiment of the inventive concept, a display apparatus may include a panel unit which comprises a plurality of sub pixels having different colors; a backlight unit which provides backlight to the panel unit using a white light source and a blue light source; an image processor which converts image data into first color frame data and second color frame data; a panel driver which turns on a first color sub pixel according to the first color frame data, and which turns on a second color sub pixel according to the second color frame data; a backlight driver for driving the backlight unit; and a controller which controls the backlight driver to consecutively turn on the white light source and the blue light source, according to operations of the panel driver.

The backlight driving unit may turn on the white light source for a predetermined period of time when the first color frame data is scanned on the panel unit, and may turn on the blue light source for a predetermined period of time when the second color frame data is scanned on the panel unit.

Additionally, the backlight driving unit may turn on the white light source for a predetermined period of time when the first color frame data is scanned on the panel unit, and may turn on both the white light source and blue light source for a predetermined period of time when the second color frame data is scanned on the panel unit.

Further, the backlight driving unit may keep the white light source turned on, and may turn on the blue light source for a predetermined period of time when the second color frame data is scanned on the panel unit.

The backlight driving unit may adjust a duty of a driving signal provided to the white light source for the period of time necessary to reduce a level of white light provided from the white light source.

In the aforementioned exemplary embodiments, the plurality of sub pixels may include a red sub pixel, a green sub pixel and a white sub pixel.

In addition, the blue light source may be implemented as a plurality of blue LEDs. The white light source may be a plurality of white LEDs where a fluorescent substance is combined on a blue LED, and each of the blue LEDs and white LEDs may be accumulated as one LED chip.

Additionally, the blue light source may be a plurality of blue LED chips, the white light source may be a plurality of white LED chips where a fluorescent substance is combined on a blue LED, and each of the blue LED chips and white LED chips may be arranged side by side.

Meanwhile, according to an exemplary embodiment of the inventive concept, a display panel may include a panel unit which comprises a plurality of sub pixels having different colors; and a backlight unit which uses a white light source and a blue light source to provide backlight to the panel unit.

Herein, the pixel may be one of an R, G, W sub pixel combination, R, C, W sub pixel combination, M, C, W sub pixel combination, and M, C sub pixel combination.

Additionally, the blue light source may be a plurality of LEDs. The white light source may be a plurality of white LEDs where fluorescent substance is combined on an LED which radiates blue light; and each of the blue LEDs and white LEDs may be accumulated as one LED chip.

In addition, according to an exemplary embodiment of the inventive concept, a backlight unit may include a plurality of blue LEDs; and a plurality of white LEDs, wherein the white LEDs may comprise a fluorescent substance combined on an LED which radiates blue light, and each of the blue LEDs and white LEDs may be accumulated as one LED chip.

According to an exemplary embodiment of the inventive concept, a display method of a display apparatus may include converting image data into first color frame data and second color frame data; panel driving which applies a driving signal to a panel unit which includes a plurality of sub pixels, and consecutively turns on a first color sub pixel which corresponds to the first color frame data and a second color sub pixel which corresponds to the second color frame data; and backlight driving which provides a backlight driving signal to a backlight unit which comprises white light source and blue light source, and selectively turns on the white light source and blue light source according to a driving state of the panel unit.

The backlight driving may turn on the white light source for a predetermined period of time when the first color frame data is scanned on the panel unit, and may turn on the blue light source for a predetermined period of time when the second color frame data is scanned on the panel unit.

Additionally, the backlight driving may turn on the white light source for a predetermined period of time when the first color frame data is scanned on the panel unit, and may turn on the white light source and blue light source together for a predetermined period of time when the second color frame data is scanned on the panel unit.

Further, the backlight driving may keep the white light source turned on, and may turn on the blue light source for a predetermined period of time when the second color frame data is scanned on the panel unit.

The backlight driving may adjust a duty of a driving signal provided to the white light source for a predetermined period of time to reduce a level of white light provided from the white light source.

In addition, the plurality of sub pixels may include a red sub pixel, a green sub pixel and a white sub pixel.

In addition, the blue light source may be a plurality of blue LEDs, the white light source may be a plurality of white LEDs where a fluorescent substance is combined on a blue LED, and each of the blue LEDs and white LEDs may be accumulated as one LED chip.

Meanwhile, according to an exemplary embodiment of the inventive concept, a transparent display system may include a transparent panel unit; at least one white light source which is arranged on one side of the transparent panel unit which provides white light to the transparent panel unit; and at least one blue light source which is arranged on one side of the transparent panel unit which provides blue light to the transparent panel unit, wherein the transparent panel unit may include a color filter layer which is divided into at least one color filter region and transparent filter region, and each of the at least one color filter region may locally include a transparent region. In addition, the at least color filter region may include red, green and white sub pixels, wherein a transparent region of the white sub pixel is larger than a transparent region for the red and green sub pixels.

The exemplary embodiments may further include a display apparatus including: a display panel which includes a panel having a sub pixel structure including sub pixels of different colors, and a backlight which uses a white light source and blue light source; an image processor which provides first color frame data and second color frame data; wherein the display panel turns on a first color sub pixel according to the first color frame data, and which turns on a second color sub pixel according to the second color frame data; and a controller which consecutively turns on the white light source and the blue light source.

The sub pixels of different colors may include at least one white sub pixel, wherein the white sub pixel together with the blue light source increases the brightness of the sub pixel structure. Also, the white light source may have a first blue LED and a second blue LED, where each of the first and second blue LEDs is electrically connected to a substrate.

A fluorescent substance may be combined on one of the blue LEDs, and each of the blue LEDs and white LEDs is accumulated as one LED chip. The backlight may include a backlight driver which adjusts a driving signal provided to the white light source for the time needed to reduce a level of the white light. In addition, the panel may include a panel driver which performs the turning on of the first color sub pixel according to the first color frame data, and which turns on the second color sub pixel according to the second color frame data, and the plurality of sub pixels may include a red sub pixel, a green sub pixel, and a white sub pixel.

According to the aforementioned various exemplary embodiments, a white light source and a blue light source may be controlled individually, thereby improving brightness thereof, and solving a color changing problem caused by a difference of characteristics of a light source.

BRIEF DESCRIPTION OF THE DRAWINGS

The above and/or other aspects of the inventive concept will be more apparent by describing certain present disclosure with reference to the accompanying drawings, in which.

DETAILED DESCRIPTION

Figure 1:
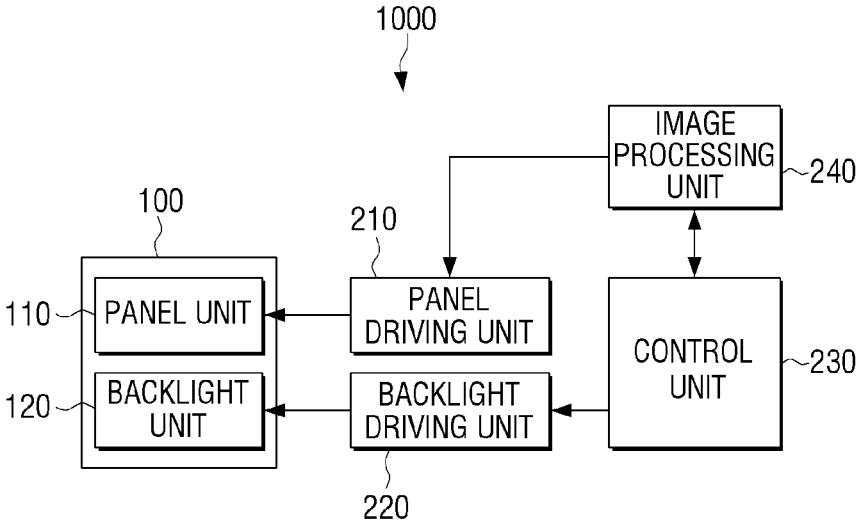
FIG. 1 is a block diagram illustrating a configuration of a display apparatus according to an exemplary embodiment of the inventive concept.

Certain exemplary embodiments are described in greater detail below with reference to the accompanying drawings.

In the following description, like drawing reference numerals are used for like elements, even in different drawings. The matters defined in the description, such as detailed construction and elements, are provided to assist in a comprehensive understanding of the exemplary embodiments. However, the exemplary embodiments can be practiced without those specifically defined matters. Also, well-known functions or constructions are not described in detail since they would obscure the application with unnecessary detail.

FIG. 1 is a block diagram illustrating a configuration of a display apparatus according to an exemplary embodiment of the inventive concept. According to FIG. 1, the display apparatus 1000 includes a display panel 100, panel driving unit 210, backlight driving unit 220, control unit 230 and image processing unit 240.

The display panel 100 includes a panel unit 110 and backlight unit 120. The panel unit 110 includes a pixel having a plurality of sub pixels which represent different colors. The panel unit 110 turns on a sub pixel of a corresponding color according to color frame data within the image data.

The backlight unit 120 includes white light source and blue light source. The backlight unit 120 consecutively turns on the white light source and blue light source and provides them to the panel unit 110.

The image processing unit 240 processes image data, and generates frame data of different colors. More specifically, the image processing unit 240 detects an R, G, B channel value from image data input from an external source, and generates R, G, B frame data which corresponds to each of the detected R, G, B channel value.

The panel driving unit 210 turns on a sub pixel of a color which corresponds to frame data of each color. A configuration and operations of a panel driving unit 210 shall be explained in detail hereinafter.

The backlight driving unit 220 provides a backlight driving signal for driving the backlight unit 120.

The control unit 230 controls overall operations of the display apparatus 1000. More specifically, when image data is input, the control unit 230 controls the image processing unit 240, and generates frame data per each color.

The image processing unit 240 consecutively provides the frame data generated per color, and the panel driving unit 210 drives the panel unit 110 so that a sub pixel of a color which corresponds to each frame data is turned on. More specifically, the panel driving unit 210 drives the panel unit 110 so that a first color sub pixel is turned on according to first color frame data, and that a second sub pixel is turned on according to second color frame data.

The control unit 230 controls the backlight driving unit 220 to selectively turn on a white light source and a blue light source according to a driving state of the panel unit 110. For example, the backlight driving unit 220 is interlocked with a display of the first color frame data to turn on the white light source, and is interlocked with a display of the second color frame data to turn on the blue light source.

Each pixel of the panel unit 110 is not configured to include an R, G, B sub pixel as in a conventional display apparatus, but rather is configured to include at least one white sub pixel. Accordingly, when the white light source is turned on at a point where remaining color sub pixels other than a white sub pixel are turned on, a color of R, G characteristics is displayed, but when the blue light source is turned on at a point where the white sub pixel is turned on, a color of B characteristics is displayed. As a result, R, G, B are consecutively turned on, displaying a color image. In addition, since a white sub pixel is used, the past problem of decreased brightness can be resolved, and the display apparatus is able to reproduce a 100% full color region of the NTSC standard.

Figure 2:
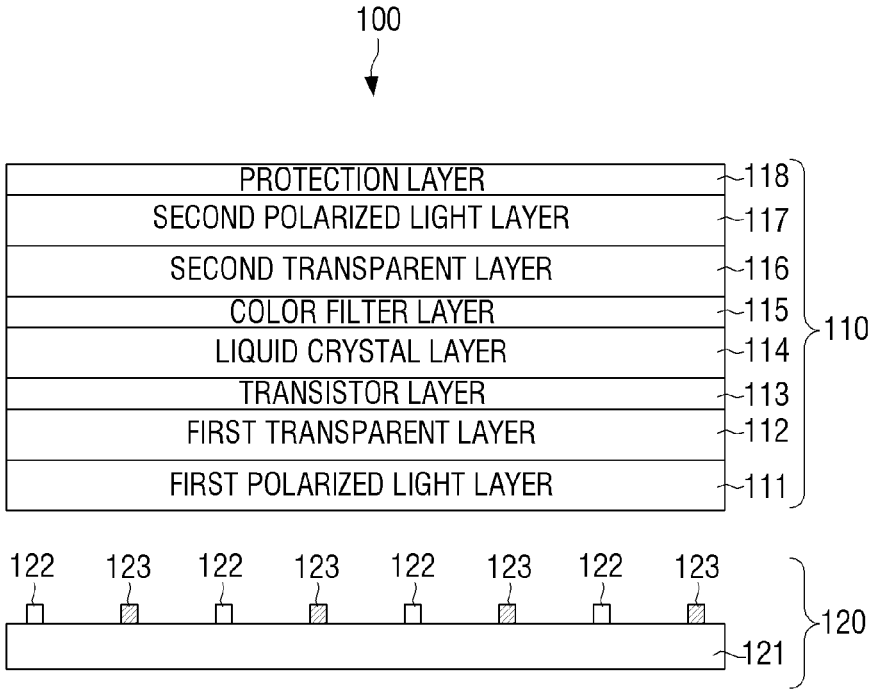
FIG. 2 is a view illustrating an example of a sectional configuration of a display panel according to an exemplary embodiment of the inventive concept.

FIG. 2 is a view illustrating a configuration of a panel unit 110 and backlight unit 120 according to an exemplary embodiment of the inventive concept. According to FIG. 2, the panel unit 110 inside the display panel 100 includes a first polarized light layer 111, first transparent layer 112, transistor layer 113, liquid crystal layer 114, color filter unit 115, second transparent layer 116, second polarized light layer 117 and protection layer 118.

The first polarized light layer 111 filters light radiated from the backlight unit 120 and trans-illuminates only light of a first polarized direction of the light. The first polarized light layer 111 may be configured as a horizontal polarized light filter or may be configured as a vertical polarized light filter. The second polarized light layer 117 is embodied as a polarized light filter inclined by 90 degrees to the first polarized light layer 111. That is, in response to the first polarized light layer 111 being a horizontal polarized light filter, the second polarized light layer 117 would be a vertical polarized light filter. However, the first polarized light layer 111 may not necessarily be arranged in a horizontal or vertical direction, but instead may be arranged at 45 degrees. The first polarized light layer 111 only needs to maintain 90 degrees to the second polarized light layer 117, in such a case as well.

Since the first and second polarized light layers 111, 117 are 90 degrees from each other, if there were only these two polarized light layers 111, 117, light cannot penetrate at all. When light which penetrated the first polarized light layer 111 changes its polarized light direction as it penetrates the liquid crystal layer 114, it penetrates the second polarized light layer 117 and enters a viewer's eye. That is, a liquid crystal arrangement of liquid crystal inside the liquid crystal layer 114 is inclined by 90 degrees in normal situations where an electrical signal is not applied. Accordingly, light filtered in a horizontal direction by the first polarized light layer 111 changes its direction in a vertical direction as it penetrates the liquid crystal layer 114, becoming able to penetrate the second polarized light layer 117. In a case where white light source is turned on in the backlight unit 120, all white light penetrates as is, and thus appears white. On the other hand, when an electrical signal is applied inside the liquid crystal layer 114, an arranged liquid crystal is aligned and thus light penetrates as is. Accordingly, since the light is filtered by the second polarized light layer 117, the light cannot penetrate, and the corresponding pixel looks black.

The first transparent layer 112 is a region which trans-illuminates light which penetrated the first polarized light layer 111. The first transparent layer 112 may include glass or other transparent high molecular material.

The transistor layer 113 is a region which includes a plurality of transistors for turning on or turning off each liquid crystal cell inside the liquid crystal layer 114. Each of the transistors may be configured as a thin film transistor (TFT). Each film transistor is connected to each liquid crystal cell inside the liquid crystal layer 114. Therefore, in a case of a SVGA (800×600) screen configuration, 3×480, 000 thin film transistors are used. A thin film transistor is an element which plays a role of a switch for each pixel, and when the thin film transistor is turned on, a molecular arrangement of liquid crystal is changed by a voltage difference between each end of a pixel when the thin film transistor is turned on. That is, it changes a direction of light or trans-illuminates the light, as is, as aforementioned.

The liquid crystal layer 114 includes a plurality of liquid crystal cells. Liquid crystal is a material which has a certain molecular arrangement like a solid. Liquid crystal molecules are twisted like twisted bread sticks when no electricity is flowing, but when electricity flows, liquid crystal molecules are arranged in one line in the direction of the electricity. Each liquid cell includes a common electrode which faces each other across the liquid crystal, and a sub pixel electrode which is electrically connected to each thin film transistor inside the transistor layer 113.

The color filter unit 115 is an element for applying color to light which penetrated the liquid crystal layer 114. The color filter unit 115 is divided into filter regions of various colors, according to exemplary embodiments. A size of each filter region may correspond to each liquid crystal cell inside the liquid crystal layer 114. Accordingly, in the inventive concept, a liquid crystal cell and filter region which corresponds thereto will be called a sub pixel for convenience of explanation.

According to an exemplary embodiment of the inventive concept, the color filter unit 115 may be embodied to have a shape where R(Red), G(Green), and W(White) filter regions are repeatedly arranged. That is, the panel unit 110 may have a shape where R, G, W sub pixels are combined and repeatedly arranged.

The panel driving unit 210 may apply an electricity signal to a liquid crystal cell which corresponds to each sub pixel, or turn on or turn off each sub cell in a method of blocking the electricity signal. Accordingly, the panel driving unit becomes able to express various color components such as red, green, and blue etc. The panel driving unit 210 may adequately adjust a turn on time of each sub pixel, and adjust a ratio of R, G, B. Accordingly, it becomes able to express various natural colors.

Explained above was an explanation of an embodiment in a case where the color filter unit 115 is configured as a combination of R, G, W pixel, but the color filter 115 may also be embodied as one of various combinations such as R, M, W sub pixel combination, R, C, W sub pixel combination, C, M, W sub pixel combination, and C, M sub pixel combination etc. These pixel combinations shall be hereinafter explained in more detail.

The second transparent layer 116 trans-illuminates the light which penetrated the color filter unit 115 towards the direction of the second polarized light layer 117. The second transparent layer 116 may also be produced with various transparent materials such as glass, etc.

The second polarized light layer 117 trans-illuminates the corresponding light of the polarized light direction as aforementioned, and blocks other light of the polarized light direction.

The protection layer 118 refers to a layer which is coated to protect an exterior of the panel unit 110. The protection layer 118 may also be produced with transparent material like glass, etc.

However, the liquid crystal layer 114 inside the panel unit 110 is unable to radiate light itself and thus needs backlight.

The backlight unit 120 uses white light source 122 and blue light source 123 to provide backlight to the panel unit 110. The white light source 122 is a light source which outputs white light which includes all three colors such as R, G, B. The white light source 122 may be configured as a general lamp, but in this exemplary embodiment, the white light source 122 is configured as a white LED. The blue light source 123 is also configured as a blue LED.

The white LED refers to an LED which coats the blue LED which radiates blue light with a fluorescent substance and changes the blue light to white light. Eu and Ce etc. which are rare earth materials, may be used as the fluorescent substance.

Instead of providing a blue sub pixel, the color filter unit 115 uses the blue light source 123 in the backlight unit 120 to express all characteristics of R, G, B. More specific methods of expression shall be explained hereinafter.

Figure 3:
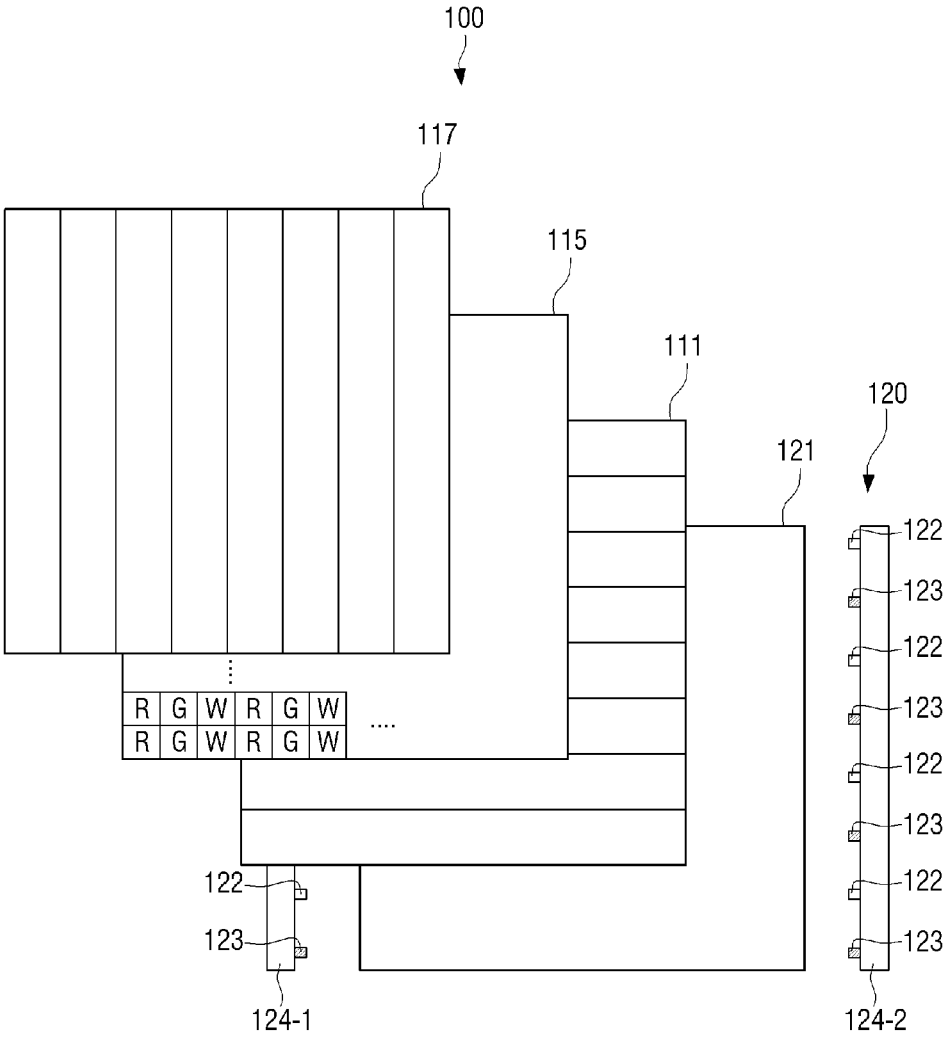
FIG. 3 is a 3 dimensional view of a configuration of a display panel.

FIG. 3 is a 3 dimensional view briefly illustrating a configuration inside a display panel. According to FIG. 3, a backlight unit 120 is placed on a lower side, and various panel layers are deposited consecutively on its upper side to form a panel unit 110.

FIG. 3 is an example of an edge type backlight unit 120. According to FIG. 3, the backlight unit 120 includes a Light Guide Plate (LGP) 121, a first and second LED bar 124-1, 124-2, a plurality of white LEDs 122, and a plurality of blue LEDs 123.

The white LEDs 122 and blue LEDs 123 are alternately placed on the first and second LED bars 124-1, 124-2. On each of the first and second LED bars 124-1, 124-2, various wires for applying electrical signals are provided, which are arranged on both ends of a light guide plate 121 to provide light from the side. Light generated from the side spreads 2-dimensionally through the light guide plate 121, and is accumulated in a front direction as it passes a spreading sheet (not illustrated) and prism sheet (not illustrated) etc., placed thereon.

The first polarized light layer 111 delivers light of the first polarized light direction of among the backlight provided from the backlight unit 120 to the direction of the liquid crystal layer 114 and color filter unit 115.

According to FIG. 3, R, G, W sub pixel region is consecutively arranged in the color filter unit 115. In a case where color frame data where R and G are mixed is expressed, the panel driving unit 210 turns on the R, G sub pixel, and the backlight driving unit 220 turns on the white light source 122. Accordingly, a red color and green color are expressed by the R, G sub pixel. In this case, when the W sub pixel is turned on together, the brightness may be further enhanced. However, since white light is further added, the color intended to be displayed may deteriorate. Therefore, whether or not to turn on the W sub pixel may be determined differently considering both brightness characteristics and color characteristics.

Next, in a case where B color frame data is expressed, the panel driving unit 210 turns off the R, G sub pixel, and turns on the W sub pixel. Furthermore, the backlight driving unit 220 turns on the blue light source 123. The blue light penetrates the W sub pixel region in its original state, and thus a blue color is expressed. In the present exemplary embodiment, R, G sub pixel is turned off, but since R, G sub pixel is unable to trans-illuminate blue light, it is also possible to keep the R, G sub pixel turned on. Such operations may be adopted differently according to the exemplary embodiments.

As a result, the red color, green color and blue color are consecutively combined to express a color image. Since the red color and green color are expressed at once, a color breakup phenomenon may be reduced, and brightness characteristics may also improve.

Figure 4:
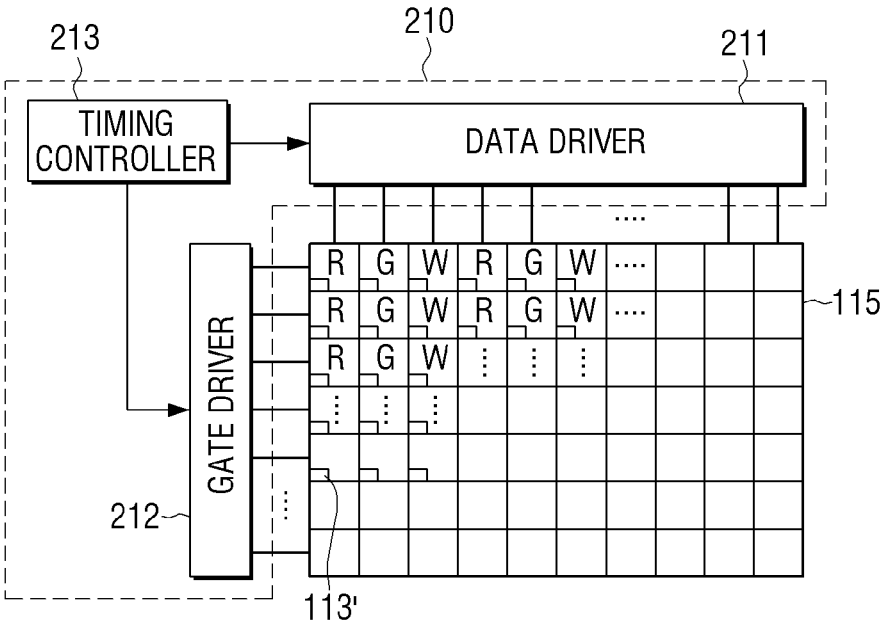
FIG. 4 is a detailed view of a configuration of a panel unit and panel driving unit.

FIG. 4 is an example of a configuration of a panel driving unit 210 for driving each sub pixel in the panel unit 110.

According to FIG. 4, the panel driving unit 210 includes a data driver 211, gate driver 212, and timing controller 213.

The data driver 211 is connected to each liquid crystal cell inside the panel unit 110 through a plurality of data lines.

Each data line is connected to a source electrode of thin film transistors 113' inside the transistor layer 113, and each gate line is connected to a gate electrode of the thin film transistors 113'. FIG. 4 illustrates a case where each liquid crystal cell consists of an R sub pixel, G sub pixel, and W sub pixel.

The gate driver 212 applies a scan pulse through a gate line, and performs a scanning operation of turning on a pixel which corresponds to each color frame. The data driver 211 applies a data signal corresponding to each pixel value inside image data to the scanned pixel, to perform a display operation.

The timing controller 213 applies a control signal to each of the data driver 211 and gate driver 212 according to image data provided from the image processing unit 240, to provide control so that the aforementioned scanning operation and display operation can be performed.

FIG. 4 illustrates an exemplary embodiment where a timing controller 213 is used, but in a case a display apparatus having a small size panel, a CPU may be used instead of a timing controller 213.

Figure 5:
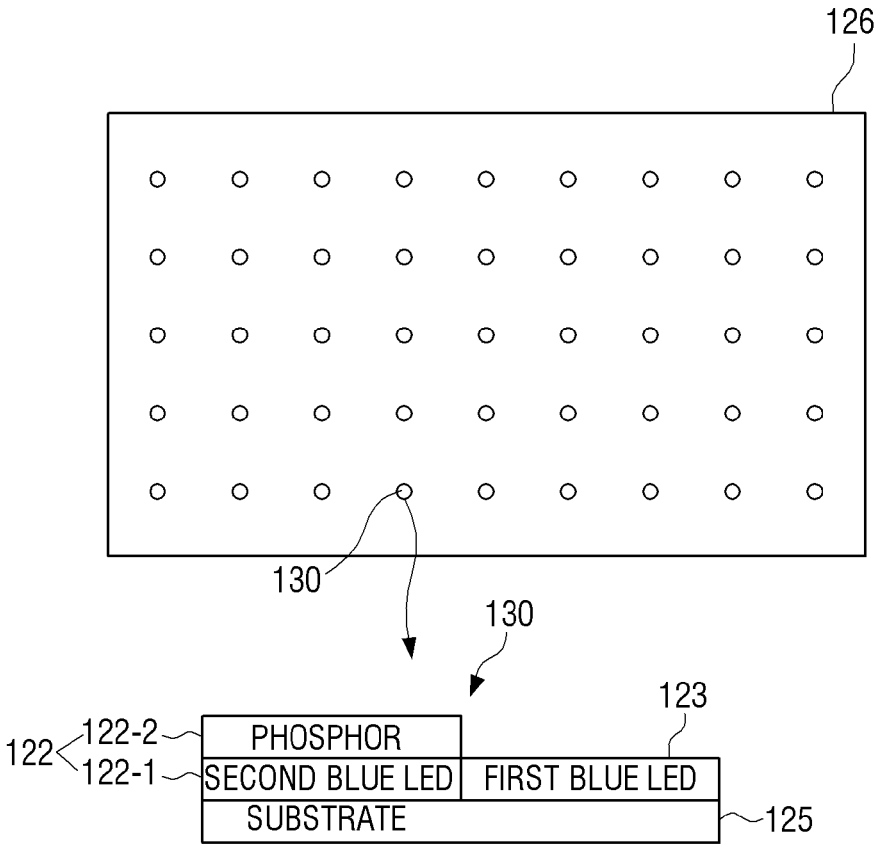
FIG. 5 is a view illustrating a configuration of a backlight unit according to an exemplary embodiment of the inventive concept.
Figure 6:
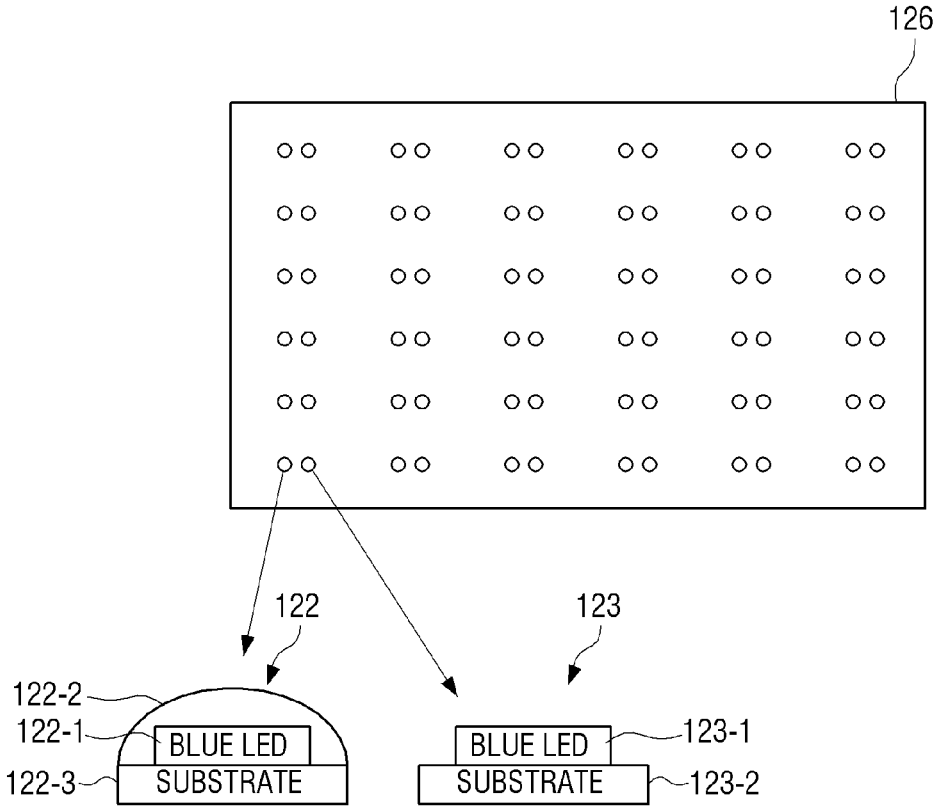
FIG. 6 is a view illustrating a configuration of a backlight unit according to another exemplary embodiment of the inventive concept.

Meanwhile, FIG. 3 illustrates a case where a backlight unit 120 is configured as an edge type, but it may also be configured as a perpendicular fall type backlight unit. FIGS. 5 and 6 illustrate various examples of a backlight unit 120 configured as a perpendicular fall type.

According to FIG. 5, the backlight unit 120 includes a base plate 126 and LED chip 130. The LED chip 130 may be arranged in a certain pattern on the base plate 126. FIG. 5 illustrates a state where each LED chip 130 is arranged in a certain fixed distance, but the inventive concept is not limited thereto, and thus an LED chip 130 may be designed to have different arrangement distances according to whether the LED chip 130 is configured as a central unit or as a corner unit.

On each LED chip 130, the white LED 122 and blue LED 123 are accumulated. The white LED 122 has a blue LED 122-1 which radiates blue light, the blue LED 122-1 covered with a fluorescent substance 122-2. In FIG. 5, the blue LED used in the white LED 122 is referred to as a second blue LED 122-1, and an additional blue LED as a first LED 123, for convenience of explanation.

The first and second blue LED 123, 122-1 are produced on the substrate 125 at the same time, and the fluorescent substance 122-2 is deposited only on the second blue LED 122-1 portion, thereby producing one LED chip 130 where a white light source and a blue light source coexist.

The substrate 125 is provided with an electrical wire (not shown) which is connected to each of the first and second blue LED 123, 122-1. Accordingly, the blue light source and the white light source may be on/off controlled on an individual basis.

FIG. 6 is a configuration of a backlight unit 120 according to another exemplary embodiment of the inventive concept. According to FIG. 6, the backlight unit 120 includes a base plate 126, a plurality of white light sources 122, and a plurality of blue lights sources 123.

Each white light source 122 may be configured as a white LED chip where fluorescent substance 122-2 is combined to the blue LED 122-1 provided on the substrate 122-3.

In addition, the blue light source 123 may be configured as a blue LED chip which includes a blue LED 123-1 provided on the substrate 123-2.

Accordingly, each of the white light source and blue white source 122, 123 may be turned on/off on an individual basis by an electrical wire provided on the base plate 126.

Meanwhile, FIGS. 5 and 6 illustrate a case where each light source includes a substrate 125, 122-3, 123-2, but in different exemplary embodiments, the base plate 126 may be used as a substrate.

In addition, FIG. 3 illustrates an edge type backlight unit 120 where white light source 122 and blue light source 123 are configured as different LEDs as in FIG. 6, but an edge type backlight 120 may obviously be configured as a type where white light source and blue light source 122, 123 are accumulated as one LED chip as in FIG. 5 as well.

As aforementioned, the backlight unit 120 includes white light source 122 and blue light source 123. The backlight driving unit 220 selectively provides a white light source 122 and a blue light source 123, to express R, G, B color.

FIGS. 7 to 10 are views illustrating various examples of a method of driving a backlight.

Figure 7:
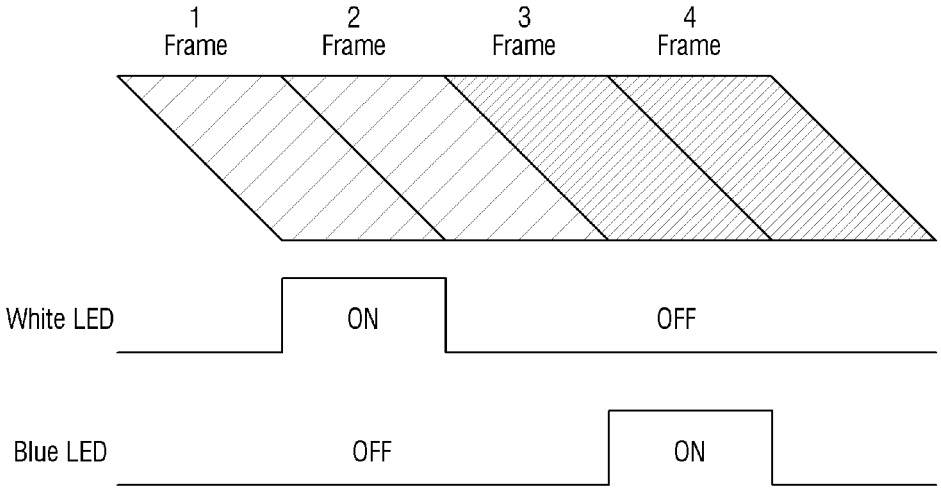
FIGS. 7 to 10 are views for explaining various examples of a method of driving a white light source and blue light source within a backlight unit.

According to FIG. 7, the panel unit 110 consecutively displays a first color frame data (first and second frame) and a second color frame data (third and fourth frame). The first and second frames are identical to each other, and the third and fourth frames are also identical to each other. FIGS. 7 to 10 illustrate an exemplary embodiment where a same frame is displayed repeatedly at least twice using a frame rate of 240 Hz, but of course may be configured to display each frame only once.

The panel driving unit 210 turns on the R and G sub pixel according to a color frame data where R and G coexist in the first and second frame.

The backlight driving unit 220 turns on white light source 122 from the point where scanning of the first frame has started and after a predetermined delay time has passed. FIG. 7 illustrates a case where scanning of the first frame is completed and the white light source 122 is turned off from the point where the scanning of the second frame starts and remains off when the scanning of the third frame starts.

Meanwhile, when a predetermined delay time passes from the point where the scanning of the third frame started, the blue light source 123 is turned on. FIG. 7 illustrates a case where the scanning of the third frame is completed and the blue light source 123 is turned on from the point where a scanning of the third frame starts, and the white light source 122 is turned off at a point where a scanning of the second frame starts again.

In a first and second frame section, the R, G sub pixel is turned on, whereas the W sub pixel is not turned on. On the other hand, in a third frame section, the R, G sub pixel is turned off, whereas only the W sub pixel is turned on. Accordingly, since the blue light source 123 is turned on when the W sub pixel is turned on, blue may be expressed through the W sub pixel. A video may be configured smoothly using such a driving method.

Otherwise, a turning on point of the white light source 122 and the blue light source 123 may be determined by a vertical sync signal. That is, it is possible to turn on the white light source 122 by synchronizing with a vertical sync signal in a section where the first and second frames are output. Furthermore, it is possible to turn on the blue light source 123 by synchronizing with the vertical sync signal in a section where the third and fourth frames are output.

Figure 8:
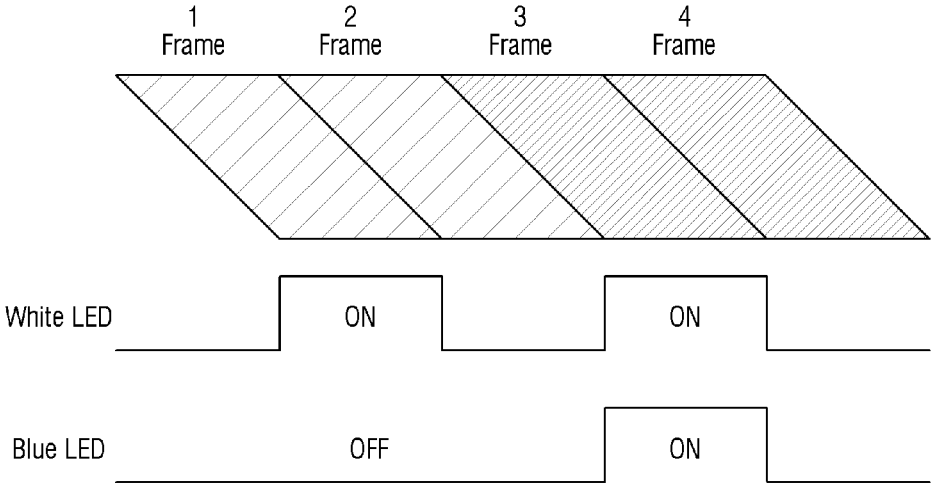

FIG. 8 is a view for explaining a backlight driving method according to another exemplary embodiment of the inventive concept. In FIG. 8, the first and second frames are identical to each other, and the third and fourth frames are identical to each other, as they were in FIG. 7. According to FIG. 8, during a partial section where the first and second frames are displayed, white light source 122 is turned on, and during a partial section where third and fourth frames are displayed, white light source 122 and blue light source 123 are turned on together. At a point of conversion from the second frame to the third frame, both the white light source and the blue light source 122, 123 are turned off. In a case of the third and fourth frames, the R, G sub pixel may not display an image and only the W sub pixel may display the image. Herein, it is possible to turn on the white light source 122 and blue light source 123 at the same time and to express blue and white through the W sub pixel. In this case, regarding the white light source 122, the intensity may be adjusted in a PWM (Pulse Width Modulation) deeming method.

When driven as in FIG. 8, white light is added together with blue light while the W sub pixel is turned on, and thus brightness may be improved.

Figure 9:
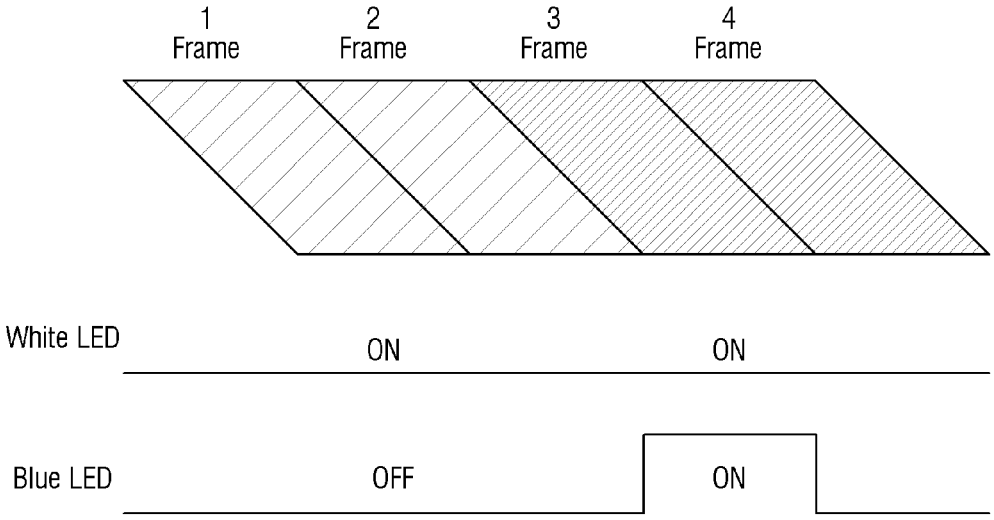

FIG. 9 is a view for explaining a backlight driving method according to another exemplary embodiment of the inventive concept. In FIG. 9, the first and second frames refers to color frame data where R, G are mixed, and the third and fourth frames refer to B color frame data.

While the first and second frames are displayed, the panel driving unit 20 turns on the R, B sub pixel and turns on the W sub pixel. In addition, the backlight driving unit 220 keeps the white light source 122 turned on.

While the third and fourth frames are displayed, the panel driving unit 210 turns off the R, G sub pixel, while only displaying the W sub pixel. Accordingly, while the third and fourth frames are displayed, both the blue light and the white light may be expressed through the W sub pixel. As a result, the brightness may be enhanced.

Figure 10:
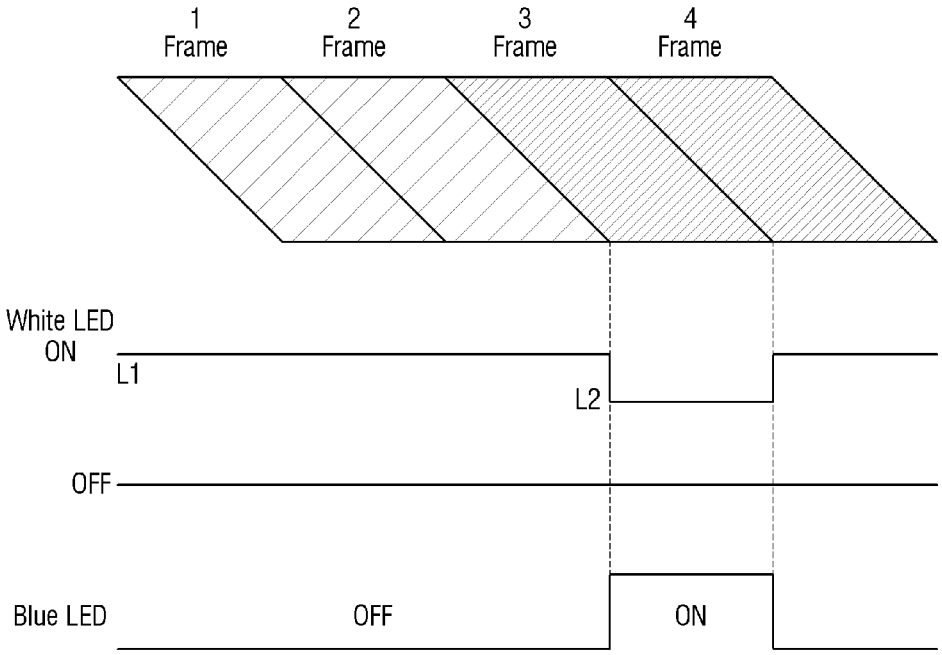

FIG. 10 is a view for explaining a backlight driving method according to an exemplary embodiment where a portion has been changed from FIG. 9. According to FIG. 10, white light source 122 is kept turned on while the first to fourth frames are displayed, but a level of white light is reduced during a section where blue light source 123 is turned on. The backlight driving unit 220 adjusts a duty of a driving signal provided to the white light source 122 while the blue light source 123 is turned on, to reduce an output level. More specifically, the backlight driving unit 220 keeps an output level of the white light source 122 to L1, and then lowers it to L2 which is below L1 while the blue light source 123 is turned on.

According to FIG. 10, it is possible to add white light and improve the brightness and at the same time prevent deterioration of color due to oversupply of white light.

Although not illustrated herein, it is also possible to keep the white light source 122 turned on and then turned off only during a section where the blue light source 123 is turned on.

Meanwhile, as aforementioned, a sub pixel may be combined in various colors. More specifically, it may be configured as one of various combinations such as R, G, W sub pixel combination, R, M, W sub pixel combination, R, C, W sub pixel combination, C, M, W sub pixel combination, and C, M sub pixel combination, etc. Hereinafter is an explanation of a color state expressed according to such pixel combinations.

Figure 11:
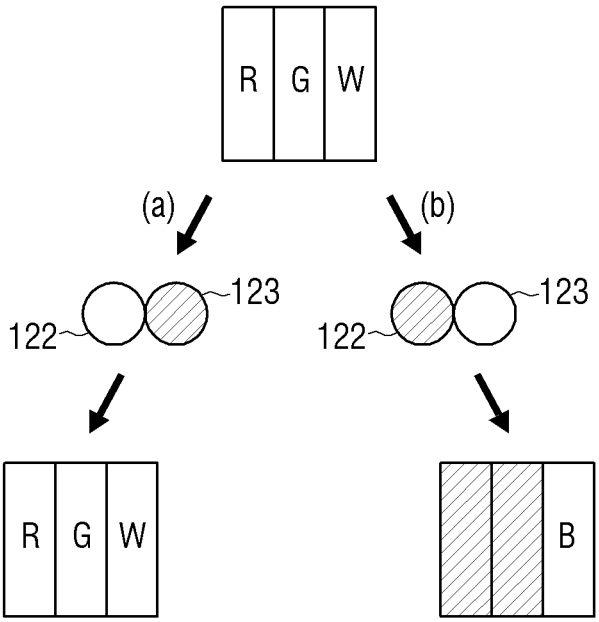
FIGS. 11 to 14 are views illustrating various examples of a configuration of a panel unit and a driving method of a backlight unit which corresponds to those configurations.

FIG. 11 illustrates a case where a panel unit 110 is configured by an R, G, W sub pixel combination. According to FIG. 11, when white light source 122 is turned on while first color frame data where R and G coexist is input (a), R and G color are expressed by the R, G sub pixel. In addition, W color is expressed by the W sub pixel. As aforementioned, in such a case, the W sub pixel may be turned off, in which case it falls into a state where no light may penetrate in the W sub pixel. However, illustrations in FIGS. 11 to 14 are based on a case where all sub pixels are turned on.

On the other hand, while the second color frame data which includes B color is input, blue light source 123 is turned on (b). In this case, blue light is unable to penetrate R and G sub pixel region, and is thus blocked, and only B color is expressed by the B sub pixel region. As a result, R and G color, and B color are consecutively displayed, enabling expressing various natural colors.

Figure 12:
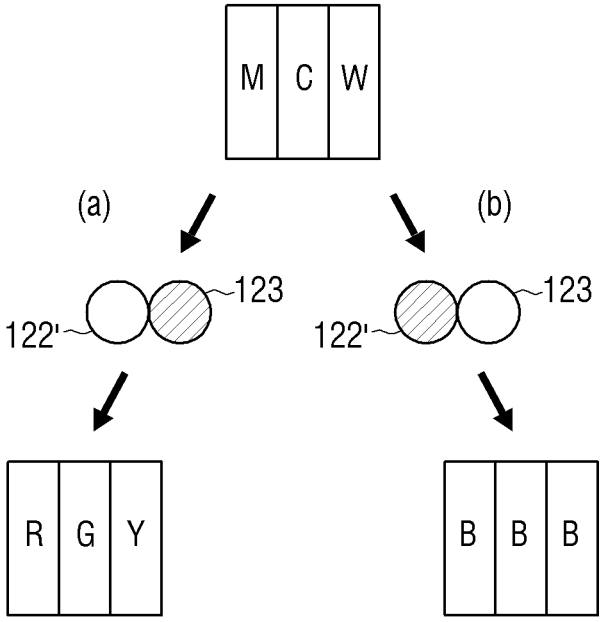

FIG. 12 illustrates a case where a panel unit 110 is configured by an M(Magenta), C(Cyan), and W sub pixel combination. In this case, white light source inside the backlight unit 120 is configured as YW light source (Yellow White light source) 122' which looks yellow, and not a pure white light source. YW light source may also be configured as an LED where fluorescent substance is combined on a blue LED. In this case, it is possible to produce a pure white LED and YW LED, respectively, by adjusting the types and composition ratios of the fluorescent substance.

According to FIG. 12, when YW light source 122' is turned on at a state where the first color frame data where R and G coexist is input, yellow light is provided (a).

M(Magenta) has a characteristic where red(R) is added to blue(B). In addition, yellow(Y) has a characteristic where green(G) is added to red(R). Therefore, of R and G color light included in the yellow light, G color light cannot penetrate the M sub pixel region, and only R color may penetrate the M sub pixel region. As a result, on the M sub pixel region, R is expressed.

On the other hand, cyan(C) has a characteristic where blue(B) is added to green(G). Therefore, of R and G color light where yellow light is included, R color light cannot penetrate C sub pixel region, but only G color light may penetrate the C sub pixel region. As a result, G is expressed on the C sub pixel region.

Y color light penetrates the W sub pixel region, and yellow is expressed.

Next, when blue light source 123 is turned on while the second frame data for expressing B color is input (b), blue is expressed on the W sub pixel region. In addition, M and C colors both have blue characteristics, and this blue is expressed on the M, C sub pixel region as well. As a result, FIG. 12 illustrates a state where blue is expressed on all the sub pixel regions.

Figure 13:
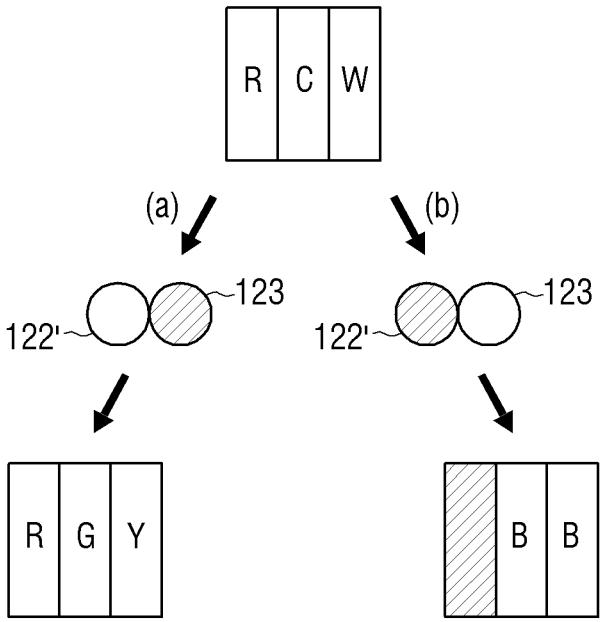

FIG. 13 illustrates a case where a panel unit 110 is configured by the R, C, W sub pixel combination. The backlight unit 120 is configured to include YW light source 122' and also includes the blue light source 123.

Accordingly, when YW light source 122' is turned on while the first color frame data where R and G coexist is input (a), R color light penetrates the R sub pixel, and g color light penetrates the C sub pixel as aforementioned. Y color light penetrates the W sub pixel.

On the other hand, when blue light source 123 is turned on while the second color frame data which represents B is input (b), B color light penetrates the W sub pixel region. In addition, since C color has a B color characteristic, B color light penetrates the C sub pixel as well. On the other hand, B color light is blocked on the R sub pixel region, and thus no light penetrates. As a result, in FIG. 13, while blue light source 123 is turned on, B color is expressed on two sub pixel regions.

Figure 14:
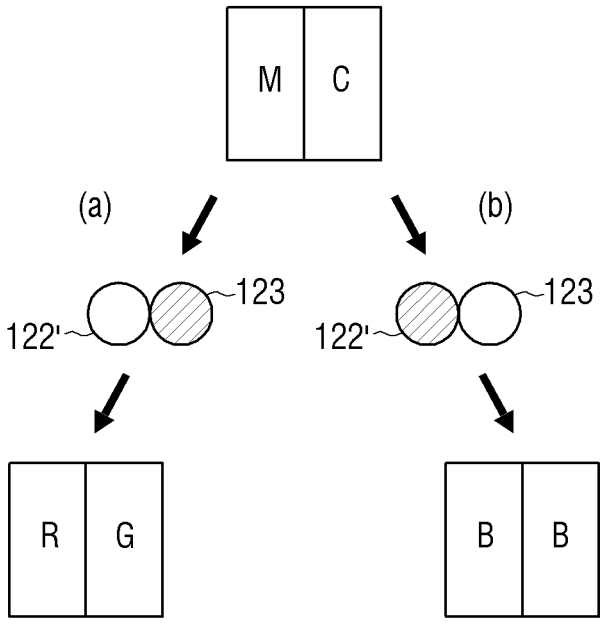

FIG. 14 illustrates a panel unit 110 having a pixel divided into two sub pixel regions. According to FIG. 14, the panel unit 110 includes M and C sub pixel region, and the backlight unit 120 includes YW light source 122' and blue light source 123.

When YW light source 122' is turned on while the first color frame data where R and G color coexist is input (a), R color light penetrates the M sub pixel region, and G color light penetrates the C sub pixel region.

On the other hand, when blue light source 123 is turned on while the second color frame data which includes B color is input (b), B color light penetrates both the M and C sub pixel region. As a result, all R, G, B are expressed, enabling the embodying of various colors. As a result, it is possible to express white light by adequately combining R, G, B color lights, even without using a pure white light source.

FIGS. 11 to 14 illustrate a state where all the sub pixels are turned on, but as aforementioned, sub pixels may be controlled to be turned on/off individually. For example, in FIG. 12 where blue light source 123 is turned on and too much blue light penetrates, it is possible to turn off at least one sub pixel region of M and C sub pixels, thereby reducing a brightness of the B color light.

In addition to FIG. 12, other exemplary embodiments may also control one/off state of each sub pixel, according to similar methods, thereby adequately improving the brightness and color thereof.

It is possible to embody the number of sub pixels and types of colors in various ways besides those illustrated in FIGS. 11 to 14. However, further illustration and explanation on combinations are omitted.

As aforementioned, the panel unit 110 and backlight unit 120 may be configured in various types to be used. Accordingly, the display apparatus 1000 of FIG. 1 may be configured as various types of apparatuses such as a TV monitor, digital picture frame, electronic display, kiosk, notebook PC, tablet PC, electronic notebook, mobile phone, PDA and MP3 player, etc.

Figure 15:
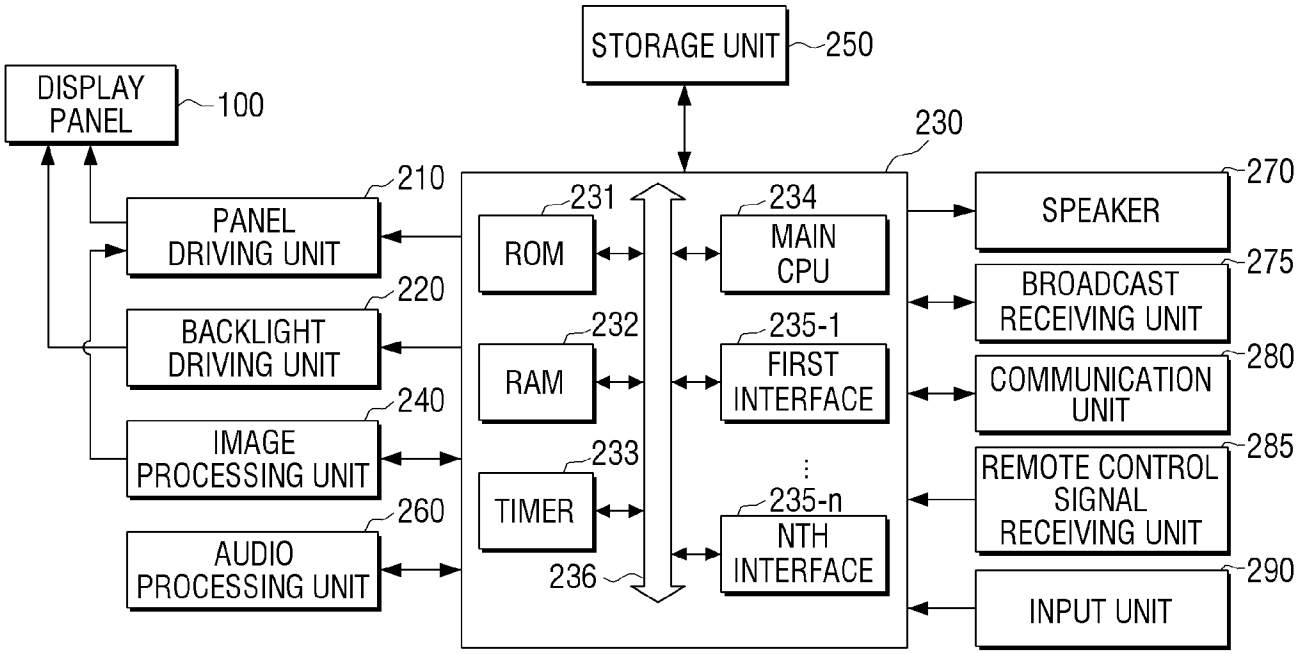
FIG. 15 is a block diagram for explaining a configuration of a display apparatus according to various exemplary embodiments of the inventive concept.

FIG. 15 illustrates a block diagram for explaining a detailed configuration in a case where the display apparatus 1000 is configured as a TV.

According to FIG. 15, the display apparatus 1000 includes a display panel 100, panel driving unit 210, backlight driving unit 220, control unit 230, image processing unit 240, storage unit 250, audio processing unit 260, speaker 270, broadcast receiving unit 275, communication unit 280, remote control signal receiving unit 285 and input unit 290.

Operations of the display panel 100, panel driving unit 210, backlight driving unit 220, control unit 230 and image processing unit 240 have already been explained in detail in FIG. 1, and thus repeated explanation is omitted.

The storage unit 250 may store the Operating System (OS) for driving the display apparatus 1000, software and firmware for performing various functions, applications, contents, setting information which a user inputs or sets while operating an application, and identification information etc., indicating characteristics of the display apparatus 1000, etc.

The control unit 230 may use various programs stored in the storage unit 250 and control the overall operations of the display apparatus 1000.

The control unit 230 includes a ROM 231, RAM 232, timer 233, main CPU 234, various interfaces 235-1~**235-*n* and bus 236**.

The ROM 231, RAM 232, timer 233, main CPU 234, and various interfaces **235-1-235-*n* are connected to one another through a bus 236**, and may transceive various data or signals, etc.

First to n interfaces **235-1-235-*n* are connected to not only various elements illustrated in FIG. 15, but also to other elements, to enable access by the main CPU 234. For example, when an external device such as a USM memory is connected, the main CPU 234** may access the USB memory through the USB interface.

When the display apparatus 1000 is connected to an external source of power, the main CPU 234 operates in a standby state. When a turn-on command is input through various input means such as remote control signal receiving unit 285 or input unit 290 etc., at a standby state, the main CPU 234 accesses the storage unit 250 and performs a booting operation using an O/S stored in the storage unit 250. In addition, CPU 234 controls various functions of the display apparatus 1000, according to information set by a user which has been previously stored in the storage unit 250.

More specifically, ROM 231 stores command sets, etc. for booting the system. When a turn-on command is input and power is supplied, the main CPU 234 copies to RAM 242 an O/S stored in the storage unit 250, according to the command stored in the ROM 231, and executes the O/S to boot the system. When the booting of the system is completed, the main CPU copies various programs stored in the storage unit 250 to the RAM 242, and executives the programs copied in the RAM 242 to perform various operations.

The timer 233 is an element for counting time according to a control operation of the main CPU 234. As aforementioned, there is an exemplary embodiment where white light source 122 or blue light source 123 is turned on after a certain time delay passes, after a panel scanning operation is performed. In such a case, the main CPU 234 controls the timer 233 to count the time passing from a point where the panel scanning has started, and controls the backlight driving unit 220 according to the counting results, to provide white light and blue light.

The remote control signal receiving unit 285 is an element which receives a remote control signal transmitted from the remote control. The remote control signal receiving unit 285 may be configured to include a light receiving unit for receiving an IR (Infra-Red) signal, or may be configured to receive a remote control signal which communicates with the remote control, according to a wireless communication protocol such as Bluetooth® or WiFi®.

The input unit 290 may be configured as various buttons provided in the main body of the display apparatus 1000. The user may input various user commands such as a turn on/off command, channel changing command, sound adjustment command, menu check command, etc., through the input unit 290.

The broadcast receiving unit 275 is an element for tuning to a broadcasting channel and processing the received signal. The broadcast receiving unit 275 may include a tuner unit, a demodulation unit, an equalization unit and a demultiplexer, etc. The broadcast receiving unit 275 may tune to a broadcasting channel according to a control operation performed by the control unit 230 and may receive a broadcasting signal which a user wants to see, and may then demodulate and equalize the received broadcasting signal, and then demultiplex the received broadcast signal into video data, audio data and additional data, etc.

Demultiplexed video data is provided to the image processing unit 240. The image processing unit 240 performs various image processes such as noise filtering, frame rate conversion, and resolution conversion, etc., and generates a frame to output on the screen of the display panel 100. In this process, the image processing unit 240 may separate data per color such as R, G, B etc., which is included in the video data, and may generate color frame data.

The demultiplexed audio data is provided to the audio processing unit 260. The audio process unit 260 may perform various processes such as decoding, amplifying, and noise filtering, etc., on the audio data.

In addition to the above, although not illustrated herein, a graphic processing unit may also be included. The graphic processing unit configures various OSD (On Screen Display) messages or graphic screens, according to a control operation of the main CPU 234. In a case where additional data such as subtitle data is included in a broadcasting signal, the main CPU 234 may control the graphic processing unit to generate a subtitle image, and may configure a frame by matching the generated subtitle image to each frame generated in the image processing unit.

The speaker 270 is an element for outputting audio data processed in the audio processing unit 260. The control unit 230 is interlocked with operations of the display panel 100 to control the speaker 270 so that video and audio data may be synchronized and output.

The communication unit 280 is an element for performing communication with various external sources according to various communication protocols. More specifically, various communication methods such as a IEEE®, WiFi®, Bluetooth®, 3G®, 4G®, and IDENTIVE NFU® (Near Field Communication), etc. can be used.

The control unit 230 may reproduce multimedia data which is received from an external source through the communication unit 280 separate from the broadcasting signal received through the broadcasting receiving unit 275.

In addition, even when the reproduce command on the multimedia data stored in the storage unit 250 is input through the remote control receiving unit 285 and input unit 290, it is possible to control the image processing unit 240 and audio processing unit 260 to process the multimedia data.

In reproducing multimedia data, and not only the broadcasting signal, the display apparatus 1000 may drive the panel unit 110 and backlight unit 120 to display an image having an appropriate brightness and color.

Besides the above, in a case where the display apparatus 1000 is configured as a multi-functional terminal such as a mobile phone or tablet PC, etc., various constituent elements, such as a camera, touch sensor, geomagnetic sensor, gyro sensor, acceleration sensor and GPS chip etc., may be further included.

Figure 16:
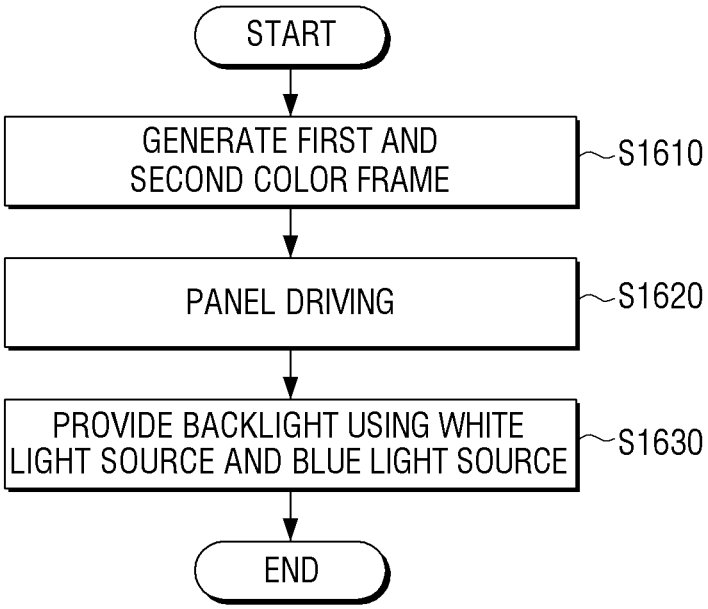
FIG. 16 is a flowchart for explaining a display method according to an exemplary embodiment of the inventive concept.

FIG. 16 is a flowchart for explaining a method of performing a color display according to an exemplary embodiment of the inventive concept. As shown in FIG. 16, the display method includes a step of converting image data into first color frame data and second color frame data (S1610). Image data may be data detected from the broadcasting signal, or may be data which has been previously stored, or may be data provided from various external sources, such as a web server or USB memory etc.

The first color frame data, for example, may be data on a frame where R color and G color are mixed, and second color frame data may be data on a frame including B color, but are not limited thereto. For example, in a case where the image data is image data converted into CMYK, it is possible to adequately combine C, M, Y, K, and differentiate color frame data.

When the data for the first and second color frame is generated, a driving signal is applied to the panel unit inside the display apparatus 1000 in order to drive the panel (S1620). As aforementioned, the panel unit 110 may include a plurality of sub pixels having different colors. While the first color frame data is being input, the panel unit 110 turns on the first color sub pixel which corresponds to the first color, and while the second color frame data is being input, the panel unit 110 turns on the second color sub pixel.

Meanwhile, while the sub pixel is turned on, the backlight driving signal is provided to the backlight unit which includes white light source and blue light source, which drive the backlight, which selectively turns on the white light source and blue light source (S1630).

A backlight driving method may be configured in various methods as explained in FIGS. 7 to 10 as aforementioned, and thus repeated explanation is omitted. In addition, the colors of the sub pixel which may be expressed as the white light source and blue light source are consecutively turned on as already explained in FIGS. 11 to 14, and thus repeated explanations is omitted.

Figure 17:
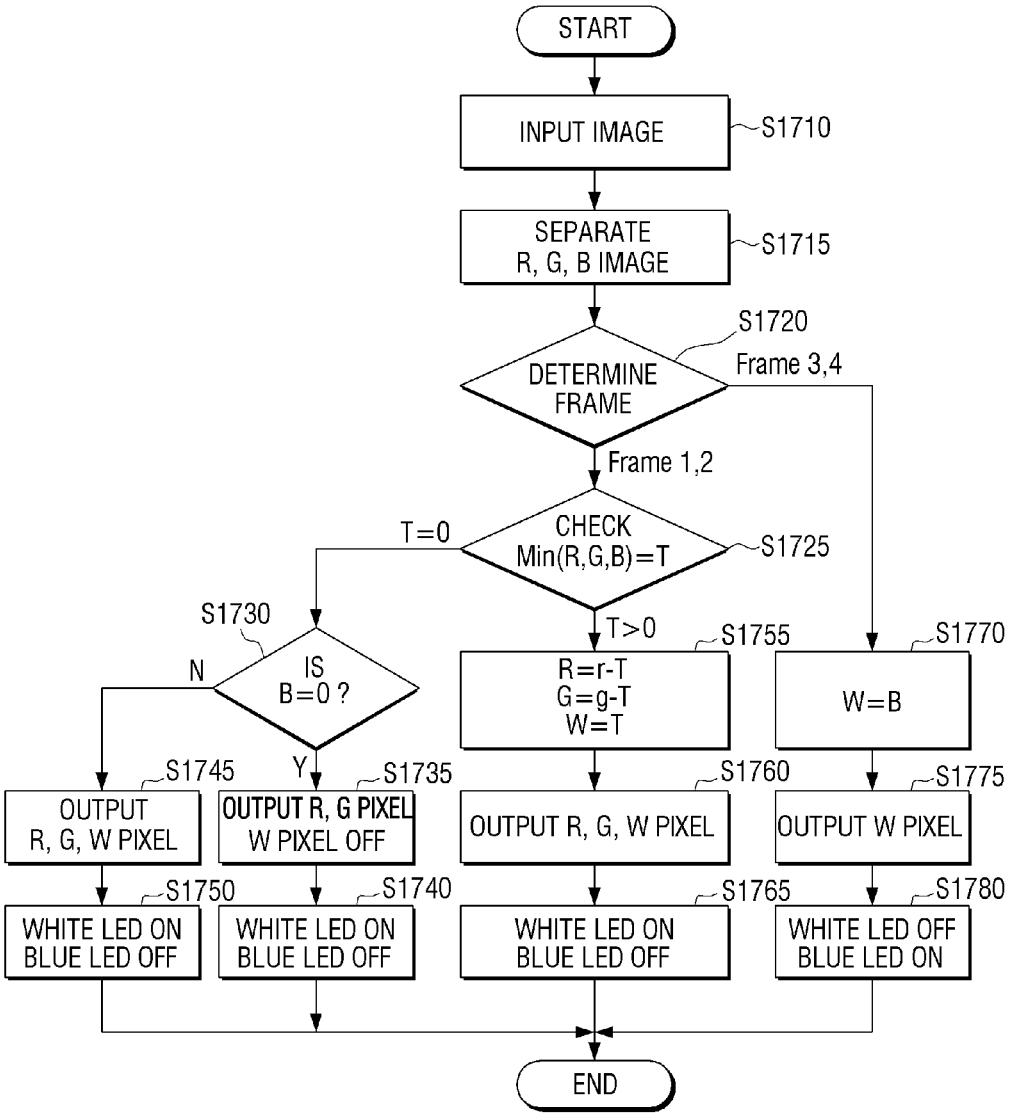
FIG. 17 is a flowchart for explaining a display panel driving method for driving a panel unit and backlight unit per image frame.

FIG. 17 is a view for specifically explaining a panel driving method and backlight driving method. FIG. 17 illustrated a case where the panel is driven by 240 Hz, but the panel driving frequency may be configured in various ways, and it is obvious that the number and frames and backlight driving timing may also differ accordingly.

According to FIG. 17, when an image is input (S1710), the image is separated into R, G, B image (S1715). The display apparatus 1000 adequately combines the separated images and generates a plurality of frames. For example, as explained in FIGS. 7 to 10, R and G images are mixed to generate 2 first color frames, B image is used to generate 2 second color frames, and then a total of 4 color frames are consecutively displayed.

When the frame currently being displayed is determined to be the first of the second frame 1, 2 (S1720), the minimum value T of the R, G, B image is confirmed (S1725).

As a result of confirmation, if T is 0, it is confirmed whether or not B image is 0 (S1730). If B image is not 0 as a result of confirmation, since R image or G image is not 0, R, G, W pixels are all turned on (S1745), and the blue LED, that is, the blue light source is turned off while turning on the white light source (S1750). The blue light source is turned on when the third and fourth frames are displayed.

Meanwhile, if B image is 0 as a result of confirmation, R, G pixels are turned on, and W pixel is turned off (S1735). In this state, white LED is turned on, and blue LED is turned off (S1740).

Meanwhile, when T exceeds 0, the R sub pixel is set as r value deducted by a minimum value T, G sub pixel is set as g value deducted by a minimum value T, W sub pixel is set as T value (S1755), and then each pixel is driven by the set value (S1760).

In this state, the white LED is turned on, and the blue LED is turned off (S1765).

Meanwhile, in a case of the third and fourth frame (S1720), the W pixel is driven by brightness which corresponds to B image (S1770, S1775). In this state the white LED is turned off and the blue LED is turned on (S1780).

According to another exemplary embodiment as aforementioned, regarding the third and fourth frame, the white LED may be turned on together with the blue LED or may be kept turned on, preventing a decrease of brightness.

As aforementioned, according to various exemplary embodiments of the inventive concept, it is possible to resolve the problem of the decreasing brightness in the R, G, B sub pixel structure, by adding the W sub pixel and using the blue LED. In addition, by using a white LED of a blue LED base together with a blue LED, it is possible to improve the phenomenon of changing brightness and wavelength, thereby preventing a deterioration of color.

Meanwhile, as aforementioned, since the display panel 100 includes the W pixel region, the display panel may be utilized in a transparent display system.

A transparent display system refers to an apparatus having a transparent characteristic, and thus a background of the apparatus appears transparent. A conventional display panel was produced using transparent semiconductor compounds such as silicon (Si) and gallium-arsenic (GaAs) etc., but since various applications fields were developed which cannot deal with conventional display panels, efforts were made to develop a new type of electronic element. A transparent display apparatus was one of those developed as a result of such effort. A transparent display apparatus is configured as a type including a transparent oxide semiconductor film, in order to have a transparent characteristic. When using a transparent display apparatus, a user may view necessary information through a transparent display apparatus screen while looking at the background which is behind the apparatus. Therefore, it is possible to resolve spatial and time constraints that have occurred with conventional display apparatuses.

Figure 18:
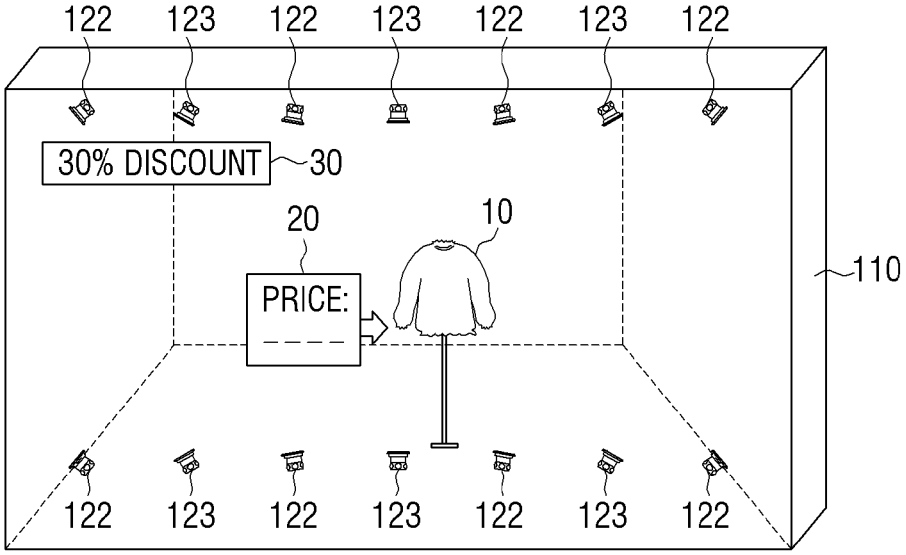
FIG. 18 is a view illustrating a configuration of a transparent display system according to an exemplary embodiment of the inventive concept.

FIG. 18 is a view which illustrates a configuration of a transparent display system according to an exemplary embodiment of the inventive concept. According to FIG. 18, a transparent display system includes a transparent panel unit 110, a plurality of white light sources 122, and a plurality of blue light sources 123.

The transparent panel unit 110 may be configured with a transparent material. When the transparent panel unit 110 is configured as in FIG. 2, a transparent substrate, transparent optical film, color filter unit, transparent thin film transistor, and transparent electrode, etc., may be used.

For example, the protection layer 118 in FIG. 2 may be configured as a transparent substrate. The transparent substrate may use a polymer material such as plastic or glass, which has a transparent characteristic.

The first and second polarized light layers 111, 117 may be configured as transparent plastic optical film. For example, a PVA (Poly Vinyl Alcohol) film where a polarized light medium such as iodine or dye is deposited, may be used.

The transistor layer 113 may be configured as a transparent transistor layer which includes a transistor produced with the nontransparent silicon of a conventional thin film transistor, replaced by transparent material such as zinc oxide and titanium oxide.

In addition, the electrode used in the panel unit 110 may be configured as a transparent electrode. ITO (indium tin oxide) or griffin may be used as the transparent electrode.

The color filter unit 115 may be produced as a color resistor binder for forming pixels such as R, G and transparent plastic material including a protection film. Generally, acrylic acid and copolymer of acrylate ester may be used for forming pixels, and thermosetting acrylic resin, polyimide (PI), and epoxy resin etc. may be used as a protection film.

The color filter unit 115 includes a color filter layer which is divided into at least one color filter and at least one transparent filter region. Herein, each of the color filter regions locally includes a transparent region.

Figure 19:
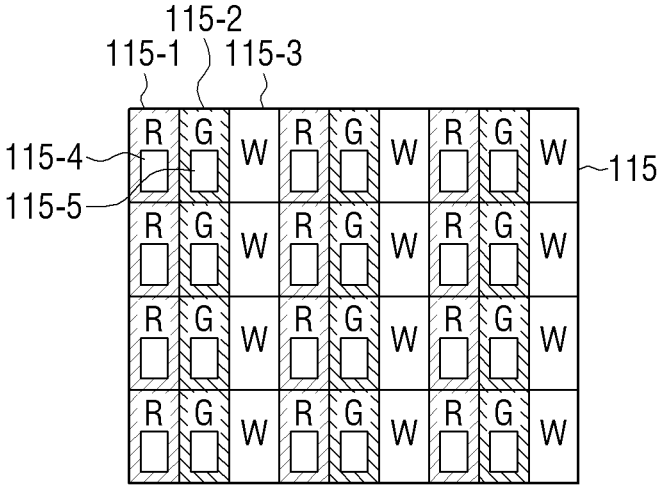
FIG. 19 is a view illustrating an example of a configuration of a color filter unit within a panel unit applied to the transparent display system of FIG. 18.

FIG. 19 is an example of a configuration of a color filter unit 115 used in the transparent panel unit 110 of FIG. 18. FIG. 19 illustrates a configuration of a color filter unit 115 where R, G, W sub pixels are combined.

In the color filter unit 115, R, G, W sub pixel regions 115-1, 115-2, 115-3 are consecutively arranged. In the R, G sub pixel region 115-1, 115-2, a locally transparent region 115-4, 115-5 is arranged. Since the W sub pixel region 115-3 is transparent, the transparent area in the transparent panel unit 110 is bigger than when consisting of R, G, B sub pixels. Therefore, transparency is improved.

According to FIG. 18, when the transparent panel unit 110 is applied to the transparent display system 1000, the background of the back side becomes transparent. FIG. 18 illustrates a case where the transparent display system 1000 is configured as a show window. In this case, products 10 displayed on the show window can be seen perfectly, and additional information 20, 30 may be displayed on the transparent panel unit 110.

FIG. 18 illustrates a state where information 20 on the product 10 and other information 30 are displayed as a type of graphic message, but various application execution screens other than those messages, contents reproduce screen, web page and other graphic objects, etc., may be displayed on the transparent panel unit 110.

In a case where the transparent display system of FIG. 18 has a configuration as FIG. 15, the control unit 230 may execute various programs stored in the storage unit 250 to generate such information.

More specifically, the control unit 230 determines coordinate values of a location of the graphic object to be displayed on the transparent panel unit 110. The display characteristics indicate the shape, size, and color, etc., of the graphic object. In addition, the control unit 230 produces a rendering according to the generated display characteristics. Accordingly, various information 20, 30 are displayed on the transparent panel unit 110.

Meanwhile, in FIG. 18, the backlight unit is not used. Instead, at least one white light source 122 and at least one blue light source 123 is placed on the back side of the transparent panel unit 110. Accordingly, backlight is provided to the transparent panel unit 110. FIG. 18 illustrates a case where the white light source 122 and blue light source 123 are placed on an upper surface and lower surface in the back side space of the transparent panel unit 110, but these light sources may be placed on a left side and right side instead.

In the transparent display system 1000 of FIG. 18 as well, the white light source 122 and blue light source 123 may be configured as a single LED chip as illustrated in FIG. 5. In addition, the light sources may be configured as a white lamp and blue lamp besides LED.

In the transparent display system 1000 of FIG. 18, the control unit 230 connected to the transparent panel unit 110 controls the operations of the transparent panel unit 110 and of each light 122, 123, to consecutively express R, G, B, color thereby displaying the color image.

Meanwhile, the methods according to the aforementioned exemplary embodiments may be generated as software and may be mounted on a display apparatus or a system.

More specifically, according to an exemplary embodiment of the inventive concept, a non-transitory computer readable medium storing a program may be installed. The programming may include: converting image data into first color frame data and second color frame data, panel driving which applies a driving signal to a panel unit which includes a plurality of sub pixels having different colors to consecutively turn on a first color sub pixel which corresponds to the first color frame data and a second sub pixel which corresponds to second color frame data, and backlight driving which provides a backlight driving signal to the backlight unit which includes white light source and blue light source to selectively turn on the white light source and blue light source according to a driving state of the panel unit.

A non-transitory computer readable medium is not a medium which stores data for a short period of time such as a resistor, cache, or memory etc., but a medium which stores data semi-permanently, and which can be read by a device. More specifically, the aforementioned various applications or programs may be stored in a non-transitory computer readable medium such as a CD, DVD, hard disk, Blu-ray Disk®, USG, memory card, and ROM.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A display apparatus comprising:

a panel comprising a plurality of sub pixels having different colors;

a backlight configured to provide a backlight to the panel only using a white light source and a blue light source;

an image processor configured to convert image data into first color frame data and second color frame data, the first color frame data being of one among a red color, a green color, and a white color, and the second color frame data being of a blue color;

a panel driver configured to turn on a first color sub pixel according to the first color frame data, and turn on a second color sub pixel according to the second color frame data, the first color sub pixel being of one among the red color, the green color, and the white color, and the second color sub pixel being of the white color;

a backlight driver configured to drive the backlight; and a controller configured to control the backlight driver to turn on the white light source according to the first color frame data in response to the panel driver turning on the first color sub pixel, and turn on the blue light source according to the second color frame data in response to the panel driver turning on the second color sub pixel.

2. The display apparatus according to claim 1, wherein the backlight driver is configured to turn on the white light source for a predetermined period of time in response to the first color frame data being scanned on the panel, and turn on the blue light source for a predetermined period of time in response to the second color frame data being scanned on the panel.

3. The display apparatus according to claim 1, wherein the backlight driver turns on the white light source for a predetermined period of time when the first color frame data is scanned on the panel, and turns on the white light source and the blue light source for a predetermined period of time when the second color frame data is scanned on the panel.

4. The display apparatus according to claim 1, wherein the backlight driver keeps the white light source turned on, and turns on the blue light source for a predetermined period of time when the second color frame data is scanned on the panel.

5. The display apparatus according to claim 4, wherein the backlight driver adjusts a duty of a driving signal provided to the white light source for the time needed to reduce a level of white light provided from the white light source.

6. The display apparatus according to claim 1, wherein the plurality of sub pixels include a red sub pixel, a green sub pixel, and a white sub pixel.

7. The display apparatus according to claim 1, wherein the blue light source is a plurality of blue LEDs, the white light source is a plurality of white LEDs, each of the plurality of white LEDs comprising a fluorescent substance disposed on a blue LED, and each of the blue LEDs and white LEDs is accumulated as one LED chip.

8. The display apparatus according to claim 1, wherein the blue light source is a plurality of blue LED chips, the white light source is a plurality of white LED chips where a fluorescent substance is combined on a blue LED, and each of the blue LED chips and white LED chips is arranged side by side.

9. The display apparatus according to claim 1, wherein the panel driver is further configured to turn off the second color sub pixel according to the first color frame data, and turn off the first color sub pixel according to the second color frame data.

10. The display apparatus according to claim 1, wherein the controller is further configured to control the backlight driver to turn off the blue light source according to the first color frame data in response to the panel driver turning on the first color sub pixel, and turn off the white light source according to the second color frame data in response to the panel driver turning on the second color sub pixel.

11. A display panel comprising:

a panel comprising a plurality of sub pixels having different colors;

a backlight configured to provide a backlight to the panel only using a white light source and a blue light source;

a panel driver configured to turn on a first color sub pixel according to first color frame data of one among a red color, a green color, a white color, a magenta color, and a cyan color, and turn on a second color sub pixel according to second color frame data of a blue color, the first color sub pixel being of one among the red color, the green color, the white color, the magenta color, and the cyan color, and the second color sub pixel being of one among the white color, the magenta color, and the cyan color; and a controller configured to control the backlight to turn on the white light source according to the first color frame data in response to the panel driver turning on the first color sub pixel, and turn on the blue light source according to the second color frame data in response to the panel driver turning on the second color sub pixel.

12. The display panel according to claim 11, wherein the blue light source is a plurality of LEDs, the white light source is a plurality of white LEDs, each of the plurality of white LEDs comprising a fluorescent substance disposed on a blue LED, and each of the blue LEDs and white LEDs is accumulated as one LED chip.

13. A method of displaying colors of a display apparatus, the method of displaying colors comprising:

converting image data into first color frame data and second color frame data, the first color frame data being of one among a red color, a green color, and a white color, and the second color frame data being of a blue color;

panel driving a driving signal to a panel comprising a plurality of sub pixels, the panel driving comprising turning on a first color sub pixel according to the first color frame data, and turning on a second color sub pixel according to the second color frame data, the first color sub pixel being of one among the red color, the green color, and the white color, and the second color sub pixel being of the white color; and backlight driving a backlight driving signal to a backlight only using a white light source and a blue light source, the backlight driving comprising turning on the white light source according to the first color frame data in response to the turning on the first color sub pixel, and turning on the blue light source according to the second color frame data in response to the turning on the second color sub pixel.

14. The method of displaying colors according to claim 13, wherein the backlight driving comprises turning on the white light source for a predetermined period of time in response to the first color frame data being scanned on the panel, and turning on the blue light source for a predetermined of time in response to the second color frame data being scanned on the panel.

15. The method of displaying colors according to claim 13, wherein the backlight driving turns on the white light source for a predetermined period of time when the first color frame data is scanned on the panel, and turns on the white light source and blue light source together for a predetermined period of time when the second color frame data is scanned on the panel.

16. The method of displaying colors according to claim 13, wherein the backlight driving keeps the white light source turned on, and turns on the blue light source for a predetermined period of time when the second color frame data is scanned on the panel.

17. The method of displaying colors according to claim 16, wherein the backlight driving adjusts a duty of a driving signal provided to the white light source for a predetermined period of time to reduce a level of white light provided from the white light source.

18. The method of displaying colors according to claim 13, wherein the plurality of sub pixels include a red sub pixel, a green sub pixel, and a white sub pixel.

19. The method of displaying colors according to claim 13, wherein the blue light source is a plurality of blue LEDs, the white light source is a plurality of white LEDs, each of the plurality of white LEDs comprising a fluorescent substance disposed on a blue LED, and each of the blue LEDs and white LEDs is accumulated as one LED chip.

20. A transparent display system comprising:

a transparent panel;

a backlight only using at least one white light source and at least one blue light source, the at least one white light source being arranged on a side of the transparent panel, the at least one white light source configured to provide white light to the transparent panel, and the least one blue light source being arranged on a side of the transparent panel, the at least one blue light source configured to provide blue light to the transparent panel, wherein the transparent panel comprises a color filter layer that is divided into at least one color filter region and at least one transparent filter region, and the at least one color filter region locally includes a transparent region;

a panel driver configured to turn on the at least one color filter region according to first color frame data of one among a red color, a green color, a white color, a magenta color, and a cyan color, and turn on the at least one transparent filter region according to second color frame data of a blue color; and a controller configured to turn on the at least one white light source according to the first color frame data in response to the panel driver turning on the at least one color filter region, and turn on the at least one blue light source according to the second color frame data in response to the panel driver turning on the at least one transparent filter region.

21. A display apparatus comprising:

a panel comprising sub pixels of different colors;

a backlight only using a white light source and blue light source;

an image processor configured to provide first color frame data and second color frame data, the first color frame data being of one among a red color, a green color, a white color, a magenta color, and a cyan color, and the second color frame data being of a blue color, wherein the panel is configured to turn on a first color sub pixel according to the first color frame data, and turn on a second color sub pixel according to the second color frame data, the first color sub pixel being of one among the red color, the green color, the white color, the magenta color, and the cyan color, and the second color sub pixel being of one among the white color, the magenta color, and the cyan color; and a controller configured to turn on the white light source according to the first color frame data in response to the panel turning on the first color sub pixel, and turn on the blue light source according to the second color frame data in response to the panel turning on the second color sub pixel.

22. The display apparatus according to claim 21, wherein the sub pixels of different colors include at least one white sub pixel.

23. The display apparatus of claim 22, further comprising:

the white light source has a first blue LED and a second blue LED;

each of the first and second blue LEDs is electrically connected to a substrate.

24. The display apparatus of claim 23 further comprising:

a fluorescent substance is combined on one of the blue LEDs, and each of the blue LEDs and white LEDs is accumulated as one LED chip.

25. The display apparatus of claim 21, further comprising:

the backlight includes a backlight driver which adjusts a driving signal provided to the white light source for the time needed to reduce a level of the white light.

26. The display apparatus of claim 25, further comprising:

the panel includes a panel driver which performs the turning on of the first color sub pixel according to the first color frame data, and which turns on the second color sub pixel according to the second color frame data.

* * * * *